US009630434B2

(12) United States Patent
Morinaga et al.

(10) Patent No.: US 9,630,434 B2
(45) Date of Patent: Apr. 25, 2017

(54) IMAGE FORMING APPARATUS, SENSOR MOUNTING JIG FOR IMAGE FORMING APPARATUS, AND METHOD FOR MOUNTING SENSOR FOR IMAGE FORMING APPARATUS

(71) Applicants: Shigeru Morinaga, Kanagawa (JP); Masayuki Sunaoshi, Ibaraki (JP)

(72) Inventors: Shigeru Morinaga, Kanagawa (JP); Masayuki Sunaoshi, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 14/843,068

(22) Filed: Sep. 2, 2015

(65) Prior Publication Data

US 2016/0075157 A1 Mar. 17, 2016

(30) Foreign Application Priority Data

Sep. 17, 2014 (JP) ..... 2014-188491

(51) Int. Cl.
*B41J 11/64* (2006.01)
*B41J 29/44* (2006.01)
*B41J 11/00* (2006.01)

(52) U.S. Cl.
CPC ..... *B41J 29/44* (2013.01); *B41J 11/0095* (2013.01); *B41J 11/64* (2013.01)

(58) Field of Classification Search
CPC . B41J 2/01; B41J 11/007; B41J 11/008; B41J 11/009; B41J 11/0095; B41J 11/64; B41J 15/048; G01C 9/12
See application file for complete search history.

(56) References Cited

U.S. PATENT DOCUMENTS

2004/0160646 A1* 8/2004 Kudo ..... H04N 1/0473 358/484
2011/0067251 A1* 3/2011 Finley ..... G01C 9/12 33/365
2011/0211210 A1 9/2011 Niihara et al.
2011/0217053 A1 9/2011 Gouda
2011/0229242 A1 9/2011 Morinaga et al.
(Continued)

FOREIGN PATENT DOCUMENTS

JP 2009-136960 6/2009
JP 4445468 1/2010
(Continued)

*Primary Examiner* — Kristal Feggins
*Assistant Examiner* — Kendrick Liu
(74) *Attorney, Agent, or Firm* — Cooper & Dunham LLP

(57) ABSTRACT

An image forming apparatus includes a transmission-type photosensor including a light-emitting part and a light-receiving part, disposed on opposite sides of a media conveyance path; a sensor retainer to retain the light-emitting part and the light-receiving part; a suspended needle indicator including one end portion freely rotatably disposed on the sensor retainer at a position higher than the photosensor, and an indicator disposed on another end thereof; and an angle viewer with scale marks that mark an angle of an optical axis of the photosensor from a vertical direction. The photosensor is disposed with the optical axis thereof is angled within a predetermined adjusted angle relative to the media conveyance path.

9 Claims, 4 Drawing Sheets

(56) References Cited

U.S. PATENT DOCUMENTS

| | | | |
|---|---|---|---|
| 2012/0032021 | A1 | 2/2012 | Morinaga et al. |
| 2013/0106946 | A1 | 5/2013 | Sunaoshi |
| 2014/0146117 | A1 | 5/2014 | Sunaoshi |
| 2014/0375729 | A1 | 12/2014 | Sunaoshi |
| 2015/0009252 | A1 | 1/2015 | Andoh et al. |
| 2015/0177136 | A1 | 6/2015 | Andoh et al. |
| 2015/0224802 | A1 | 8/2015 | Kawamichi et al. |

FOREIGN PATENT DOCUMENTS

| | | | |
|---|---|---|---|
| JP | 2011-186093 | | 9/2011 |
| WO | WO2005/021829 | A1 | 2/2005 |

* cited by examiner

IMAGE FORMING APPARATUS, SENSOR MOUNTING JIG FOR IMAGE FORMING APPARATUS, AND METHOD FOR MOUNTING SENSOR FOR IMAGE FORMING APPARATUS

CROSS-REFERENCE TO RELATED APPLICATION

The present application claims priority pursuant to 35 U.S.C. §119(a) from Japanese patent application number 2014-188491, filed on Sep. 17, 2014, the entire disclosure of which is incorporated by reference herein.

BACKGROUND

Technical Field

Exemplary embodiments of the present invention relate to an image forming apparatus, a sensor mounting jig, and a method for mounting a sensor to the image forming apparatus.

Background Art

Conventional image forming apparatuses include a reflection-type photosensor to detect a transfer medium conveyed along a media conveyance path. Such a reflection-type photosensor is used to detect a position alignment mark or a preprint mark on the transfer medium with high precision, regardless of the type of transfer medium, for example, whether the transfer medium, such as a recording sheet, a web, or an intermediate transfer medium, is glossy or not.

By contrast, with a transmission-type photosensor, the optical axis of the photosensor or optical sensor needs to have a predetermined angle relative to the media conveyance path, for example, perpendicular to the conveyance path.

However, when the media conveyance path inclines relative to a reference direction, for example, a horizontal direction, the optical sensor needs to be mounted with its optical axis angled relative to the inclination of the media conveyance path.

SUMMARY

In one embodiment of the disclosure, there is provided an optimal image forming apparatus including a transmission-type photosensor including a light-emitting part and a light-receiving part, disposed on opposite sides of a media conveyance path; a sensor retainer to retain the light-emitting part and the light-receiving part; a suspended needle indicator including one end portion freely rotatably disposed on the sensor retainer at a position higher than the photosensor, and an indicator disposed on another end thereof; and an angle viewer with scale marks that mark an angle of an optical axis of the photosensor from a vertical direction. The photosensor is disposed with the optical axis thereof is angled within a predetermined adjusted angle relative to the media conveyance path.

These and other objects, features, and advantages of the present invention will become apparent upon consideration of the following description of the preferred embodiments of the present invention when taken in conjunction with the accompanying drawings.

DETAILED DESCRIPTION

Figure 1:
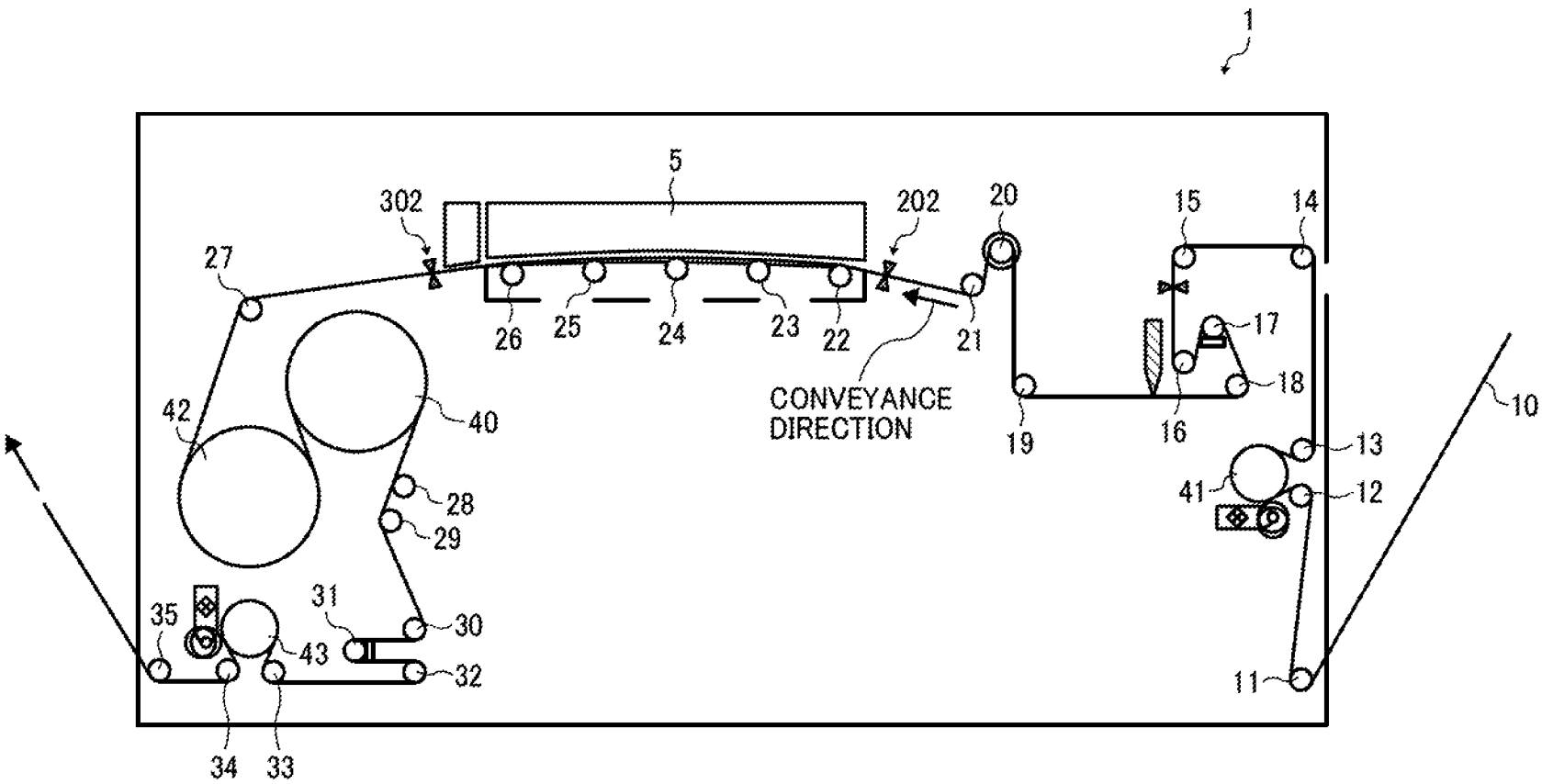
FIG. 1 schematically illustrates an image forming apparatus according to an embodiment of the present invention.
Figure 2:
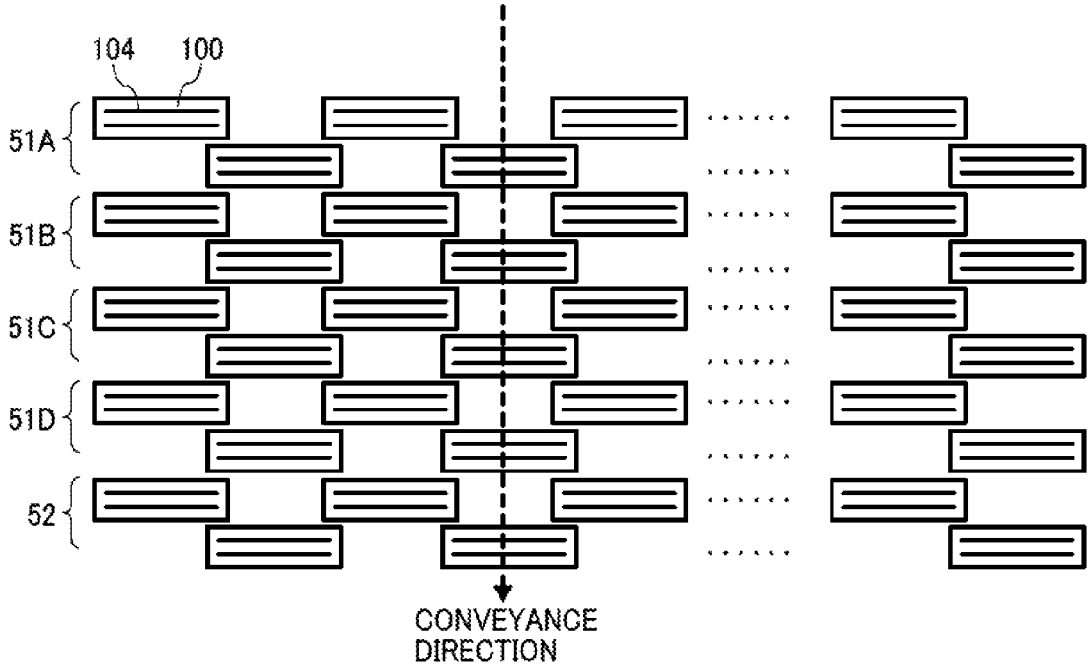
FIG. 2 is a plan view of a main part of an image forming section of the image forming apparatus of FIG. 1.

First, an example of an image forming apparatus according to an embodiment of the present invention will be described with reference to FIGS. 1 and 2. FIG. 1 is an explanatory side view of the image forming apparatus, and FIG. 2 is a plan view illustrating the main part of the image forming section of the image forming apparatus of FIG. 1.

In the present embodiment, the image forming apparatus is a full-line inkjet recording apparatus. The image forming apparatus is configured such that a recording medium 10 as a continuous sheet is supplied from outside an apparatus body 1, an image is formed on the recording medium 10, and the recording medium 10 is conveyed outside the apparatus body 1. Various treatments are applied to the recording medium 10 in a postprocessor that performs cutting, winding, and/or binding.

The recording medium 10 entering the apparatus body 1 is conveyed by a conveyance drive force supplied by rollers 11 to 35, a heater roller 40, and motors 41, 42, and 43, and exits the apparatus body 1.

The recording medium 10 is guided, retained, and conveyed by the rollers 22 to 26 opposing an image forming section 5, during which an image is formed thereon with liquid droplets discharged from the image forming section 5.

Recording heads 51A to 51D each as a first liquid discharge head discharge ink droplets onto the recording medium 10. As illustrated in FIG. 2, the recording heads 51A to 51D are disposed in this order from upstream to downstream in a media conveyance direction, or simply, a conveyance direction.

Each of the recording heads 51A to 51D includes a plurality of heads 100, each of which includes two nozzle arrays including nozzles 104. The plurality of heads 100 in each of the recording heads 51A to 51D are disposed in zigzag alignment in the nozzle alignment direction, thereby forming one line.

The recording heads 51A to 51D discharge ink droplets of each color of yellow (Y), cyan (C), magenta (M), and black (K), for example. It is to be noted that the colors of ink and the number of colors are not limited to the above.

In addition, the image forming section 5 includes a treatment liquid head 52 as a second liquid discharge head disposed downstream of the recording head 51D as the first liquid discharge head in the media conveyance direction.

The treatment liquid head 52 also includes a plurality of heads 100, each of which includes two nozzle arrays including nozzles 104 and the plurality of heads 100 are disposed in zigzag alignment in the nozzle alignment direction, thereby forming one line.

The treatment liquid head 52 discharges a transparent liquid (or a treatment liquid) to improve the quality of printed matter by improving image fixability using an overcoat, or alternatively, improving gloss.

The image forming apparatus further includes transmission-type photosensors 202, 302 disposed upstream and downstream of the image forming section 5 in the media conveyance direction, each of which serves as a medium sensor to detect the recording medium 10.

Figure 3:
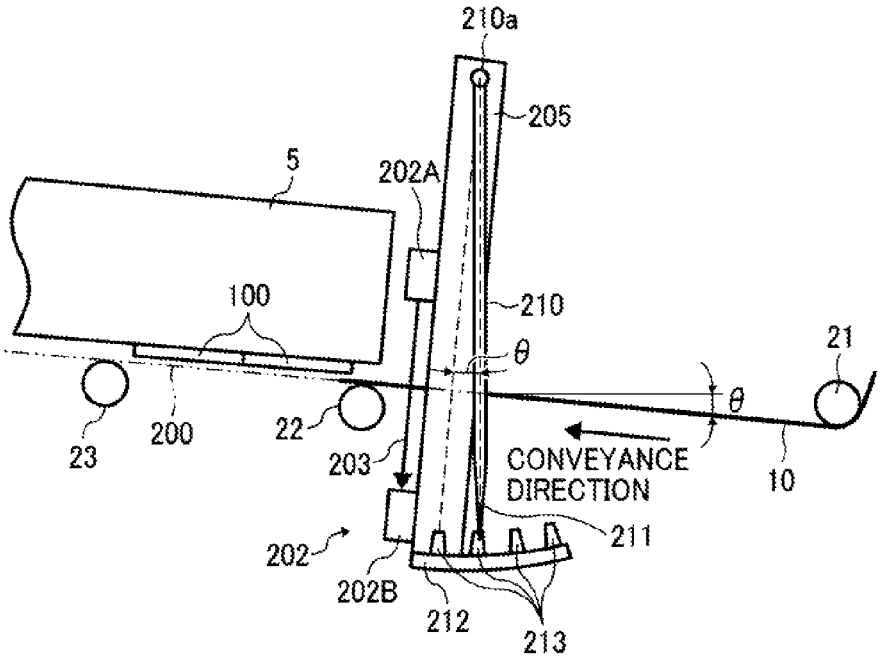
FIG. 3 is a schematic view of the image forming section illustrating a principle part thereof according to a first embodiment of the present invention.

FIG. 3 is a schematic view of the image forming apparatus illustrating a principle part thereof according to the first embodiment of the present invention.

In the media conveyance direction, the transmission-type photosensor 202 to detect the recording medium 10 conveyed along a media conveyance path 200, is disposed upstream of the image forming section 5 in the media conveyance direction.

The photosensor 202 includes a light-emitting part 202A and a light-receiving part 202B disposed via the media conveyance path 200, and detects the recording medium 10 by detecting light beams 203 emitted from the light-emitting part 202A with the light-receiving part 202B. In the present embodiment, the light-emitting part 202A is disposed vertically above the light-receiving part 202B; however, alternatively the light-receiving part 202B may be disposed vertically above the light-emitting part 202A.

Based on the detection result of the recording medium 10 by the photosensor 202, discharge timing (that is, image forming start timing) by the recording heads 51A to 51D and the treatment liquid head 52 is determined.

The photosensor 202 is secured to a sensor retainer 205. The sensor retainer 205 is adjustable, so that an angle from the vertical direction of the optical axis of the light beams 203 of the photosensor 202 can be adjusted.

The sensor retainer 205 includes a suspended needle indicator 210, including an end portion 210*a* freely rotatably disposed on the sensor retainer 205 at a position higher than the photosensor 202.

The sensor retainer 205 further includes an indicator 211 disposed on the other end of the needle indicator 210, and an angle viewer 212 with scale marks 213 for ascertaining an angle of the optical axis of the photosensor 202 from the vertical direction in accordance with an indication by the indicator 211.

Herein, the scale marks 213 of the angle viewer 212 are formed by protrusions, each forming one scale mark, but may be formed of concave portions.

The photosensor 202 is disposed within a predetermined adjusted angle relative to the media conveyance path 200 using the needle indicator 210 and the angle viewer 212.

Hereinafter, a method for mounting the sensor will be described using the needle indicator 210 and the angle viewer 212.

As described above, based on the detection result of the photosensor 202, the image forming start timing is determined. Accordingly, it is mandatory that the optical axis of the light beams 203 be perpendicular to the media conveyance path 200 to improve precision in detecting the medium 10 by the photosensor 202.

However, when the media conveyance path 200 is angled, the light-emitting part 202A and the light-receiving part 202B of the photosensor 202 need to be disposed with an optical axis angled relative to the vertical direction.

Then, using the needle indicator 210 and the angle viewer 212, the angle of the optical axis of the photosensor 202 from the vertical direction is ascertained and the position of mounting the sensor retainer 205 is adjusted. Thus, the angle of the photosensor 202 from the vertical direction is adjusted, so that the optical axis of the photosensor 202 is disposed to have a predetermined angle relative to the media conveyance path 200.

Specifically, the photosensor 202 first retained to the sensor retainer 205, is mounted to the apparatus body 1. In this case, because the leading end of the indicator 211 of the needle indicator 210 hangs vertically, the sensor retainer 205 is disposed with a same angle θ from the vertical direction as an angle θ of the media conveyance path 200 relative to the horizontal direction.

With this structure, the photosensor 202 is disposed such that the optical axis thereof is angled by an angle θ relative to the vertical direction.

As described above, the inclined angle θ of the media conveyance path 200 from the horizontal direction is the same angle θ formed between the sensor retainer 205 and the needle indicator 210. Accordingly, when the sensor retainer 205 is secured to the apparatus body 1 such that the photosensor 202 is disposed with the above angle, the photosensor 202 can be disposed to the apparatus body 1 with the optical axis thereof inclined by a predetermined angle.

When the photosensor 202 is mounted to the apparatus body 1, it is preferred that a detection error of the photosensor 202 be calibrated, that is, previously measured before mounting to the apparatus body 1, and the detection error be corrected after mounting, in order to improve precision in the output performance of the photosensor 202 at a detection position. With this, even without calibration after mounting, optimal detection precision of the photosensor 202 can be obtained.

In order to obtain optimal detection precision when mounting the photosensor 202, the photosensor 202 needs to be mounted with a previously measured detection error before mounting to the apparatus body 1.

Specifically, when the photosensor 202 is disposed with an angle such that the optical axis of the photosensor 202 is perpendicular to the media conveyance path 200, the optical axis of the photosensor 202 is set to within a predetermined adjusted range (that is, within an allowable mounting error range) relative to the media conveyance path 200.

In this case, one scale mark (that is, one protrusion) of the scale marks 213 of the angle viewer 212 represents an adjusted range (or the allowable mounting error range).

Then, by adjusting the position of the sensor retainer 205 so that the indicator 211 of the needle indicator 210 is within one scale mark (one protrusion), the photosensor 202 can be disposed such that the optical axis thereof is perpendicular to the media conveyance path 200 within a predetermined adjusted range relative to the media conveyance path 200.

With this adjustment, the photosensor 202 can be disposed at an angle within an allowable range (within a predetermined adjusted range) relative to the attitude of the photosensor 202 in the previous measurement of the detection error before actual mounting.

Specifically, the angle within a predetermined adjusted range means an angular range of allowable error relative to a reference angle, when the reference angle is when an angle of the optical axis perpendicular to the media conveyance path.

Thus, with an uncomplicated structure, the photosensor 202 can be mounted such that the optical axis thereof relative to the inclination of the media conveyance path 200 is within a predetermined adjusted range.

In this case, a length of the needle indicator 210 is configured to be longer than a distance between the light-emitting part 202A and the light-receiving part 202B of the photosensor 202.

With this structure, a varying amount on the scale marks 213 of the angle viewer 212 relative to the change in an angle of the needle indicator 210 increases, so that an adjustment of the mounting angle of the photosensor 202 is made easier, thereby improving the precision.

Figure 4:
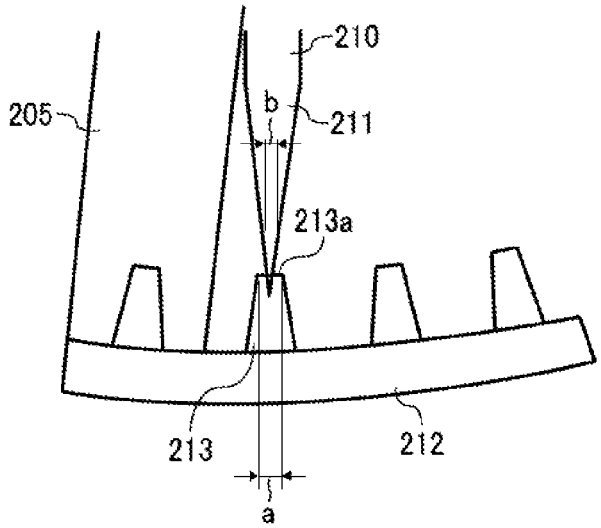
FIG. 4 is a schematic view of the image forming section illustrating a principle part thereof according to a second embodiment of the present invention.

FIG. 4 is a schematic view of the image forming apparatus illustrating a principle part thereof according to the second embodiment of the present invention.

In the present embodiment, the scale marks 213 of the angle viewer 212 include a flat portion 213*a* representing an adjusted range of the optical axis of the photosensor 202.

The flat portion 213*a* includes a width "a" that is determined by a length of the needle indicator 210 and an allowable range of the adjustment error. The width "a" of the flat portion 213*a* is wider than a width "b" of the indicator 211 of the needle indicator 210. The width "a" of the flat portion 213*a* is wider than a width "b" of the indicator 211 of the needle indicator 210.

As configured above, by making a part of the scale mark 213 to be a flat portion 213*a*, the flat portion 213*a* can be used as an indication to make the adjustment range within a predetermined range, easily. The indication may be disposed on the needle indicator 210 instead of the scale mark 213. Specifically, a flat portion having a width larger than that of the scale mark 213 of the angle viewer 212 can be provided to the needle indicator 210.

Figure 5:
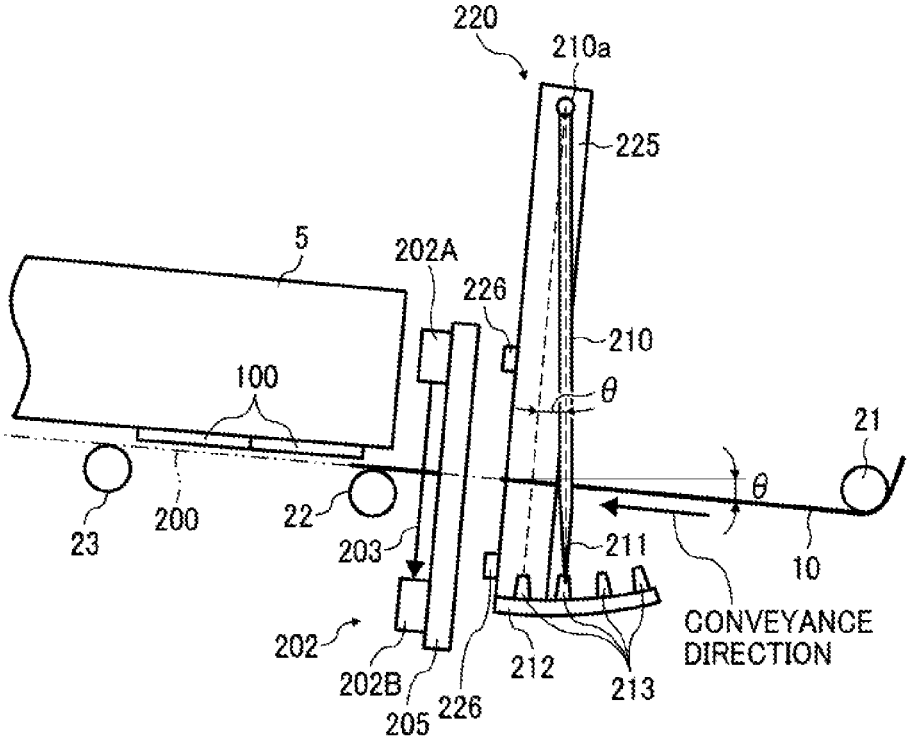
FIG. 5 is a schematic view of the principal part of the image forming apparatus including a sensor mounting jig according to a third embodiment of the present invention.

FIG. 5 is a schematic view of a principal part of the image forming apparatus including a sensor mounting jig according to a third embodiment of the present invention.

A sensor mounting jig 220 for the image forming apparatus according to the present embodiment includes joint members 226 and a jig body 225 detachably connectable to the sensor retainer 205 via the joint members 226. The joint members 226 can be a magnet or a screw.

The jig body 225 includes the needle indicator 210 suspended with an end portion 210*a* freely rotatably retained to the needle indicator 210.

The jig body 225 further includes an indicator 211 disposed at another end of the needle indicator 210, and an angle viewer 212 with scale marks 213 that mark an angle of the optical axis of the photosensor 202 from a vertical direction or a direction of gravitational force because the angle is indicated by the indicator 211.

When the photosensor 202 is mounted using the sensor mounting jig 220, the sensor mounting jig 220 is connected to the sensor retainer 205 via the joint members 226.

In this case, similarly to the first embodiment, the scale marks 213 of the angle viewer 212 of the needle indicator 210 shows an inclination of the optical axis of the photosensor 202 relative to the vertical direction.

Accordingly, similarly to the first embodiment, the inclination of the optical axis of the photosensor 202 relative to the vertical direction is marked, and the photosensor 202 can be mounted such that the optical axis of the photosensor 202 has an angle within a predetermined adjusted range relative to the direction perpendicular to the media conveyance path 200.

After the photosensor 202 has been mounted, the sensor mounting jig 220 is separated from the sensor retainer 205 and is detached from the apparatus body 1.

Figure 6:
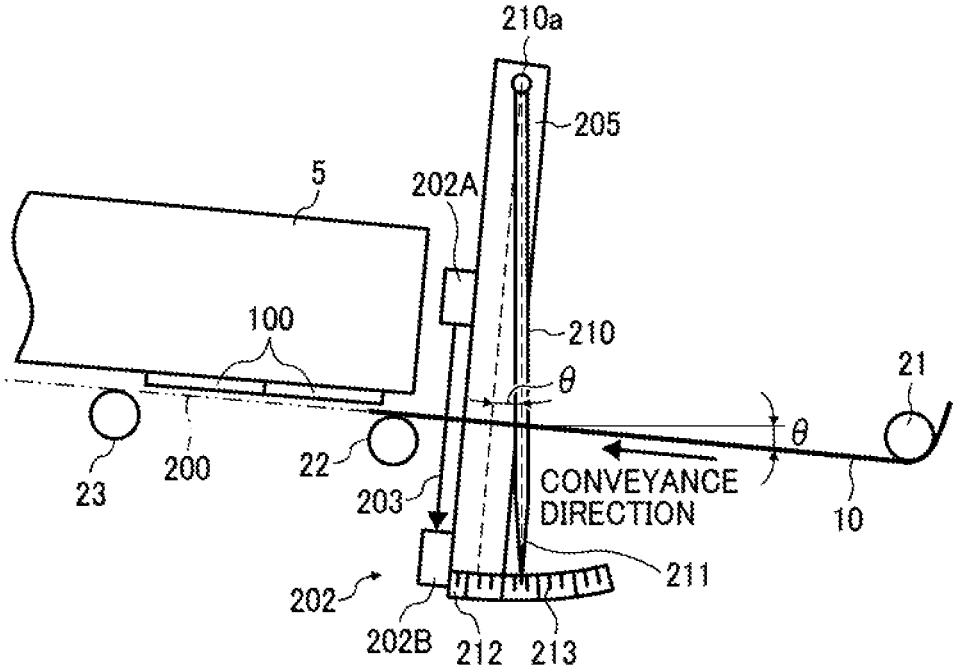
FIG. 6 is a schematic view of the principal part of the image forming apparatus according to a fourth embodiment of the present invention.

FIG. 6 is a schematic view of the principal part of the image forming apparatus according to a fourth embodiment of the present invention.

In the present embodiment, the scale marks 213 of the angle viewer 212 as described in the first embodiment are formed of graduated lines.

With this structure, change in the angle can be represented in precise figures.

As a pointer, a long needle, a string and weight, and the like can be used.

In addition, when a plurality of heads is mounted as described above, the graduated line for each of the plurality of heads can be provided to the angle viewer 212. With this structure, each of the plurality of heads can be adjusted.

The same structure can be applied to mounting the transmission-type photosensor 302 disposed downstream of the image forming section 5 in the media conveyance direction.

The term "medium" includes not only a sheet, recorded medium, recording medium, recording sheet, and the like, but also a continuous sheet, cut paper, paper roll, and the like. The terms image formation, recording, printing, image printing, and the like, all have the same meaning.

Further, the image forming apparatus includes, otherwise limited in particular, any of a serial-type image forming apparatus and a line-type image forming apparatus. The image forming apparatus may employ, not only the liquid discharging method, but also electrophotographic method, and any other type of recording head.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a transmission-type photosensor including a light-emitting part and a light-receiving part, disposed on opposite sides of a media conveyance path;

a sensor retainer to retain the light-emitting part and the light-receiving part;

a suspended needle indicator including one end portion freely rotatably disposed on the sensor retainer at a position higher than the photosensor, and an indicator disposed on another end thereof; and an angle viewer with scale marks that mark an angle of an optical axis of the photosensor from a vertical direction, wherein the sensor retainer is adjustable such that the photosensor is disposed with the angle of the optical axis of the photosensor being within a predetermined adjusted range relative to the media conveyance path.

2. The image forming apparatus as claimed in claim 1, wherein a length of the needle indicator is longer than a distance between the light-emitting part and the light-receiving part of the photosensor.

3. The image forming apparatus as claimed in claim 1, wherein the scale marks of the angle viewer are formed of protrusions or concave portions.

4. The image forming apparatus as claimed in claim 1, wherein:

the scale marks of the angle viewer are formed of protrusions or concave portions, each scale mark of the angle viewer includes a portion representing an adjusted range of the optical axis of the photosensor, and a width of the portion is wider than a width of the indicator of the needle indicator.

5. The image forming apparatus as claims in claim 1, wherein a length of the needle indicator is longer than a distance between the light-emitting part and the light-receiving part of the photosensor, and the scale marks of the angle viewer are formed of protrusions or concave portions.

6. The image forming apparatus as claims in claim 1, wherein a length of the needle indicator is longer than a distance between the light-emitting part and the light-receiving part of the photosensor, the scale marks of the angle viewer are formed of protrusions or concave portions, each scale mark of the angel viewer includes a portion representing an adjusted range of the optical axis of the photosensor, and a width of the portion is wider than a width of the indicator of the needle indicator.

7. An image forming apparatus comprising:

a transmission-type photosensor including a light-emitting part and a light-receiving part, disposed on opposite sides of a media conveyance path, to detect a recording medium on the media conveyance path; and a sensor retainer to retain the light-emitting part and the light-receiving part, the sensor retainer including an angle viewer with scale marks for determining an angle of an optical axis of the photosensor relative to a vertical direction, wherein the media conveyance path is inclined relative to a horizontal direction, and the sensor retainer is adjustable such that the photosensor is disposed with an inclination of the optical axis of the photosensor relative to the vertical direction being within a predetermined adjusted range corresponding to the scale marks of the angle viewer.

8. A sensor mounting jig for an image forming apparatus, comprising:

a jig body connectable to a sensor retainer of the image forming apparatus to retain a light-emitting part and a light-receiving part of a photosensor of the image forming apparatus;

a suspended needle indicator having a length longer than a distance between the light-emitting part and the light-receiving part disposed on opposite sides of a media conveyance path, the needle indicator including one end portion freely rotatably disposed on the jig body at a position higher than the photosensor, and an indicator disposed on another end thereof; and an angle viewer with scale marks that mark an angle of an optical axis of the photosensor from a vertical direction, wherein the jig body when connected to the sensor retainer is adjustable such that the photosensor retained by the sensor retainer is disposed with the angle of the optical axis of the photosensor relative to the vertical direction being within a predetermined adjusted range.

9. A method for mounting a sensor for an image forming apparatus, comprising:

providing the photosensor including the light-emitting part and the light-receiving part, disposed on opposite sides of a media conveyance path;

connecting the sensor mounting jig as claimed in claim 8, to the sensor retainer to retain the photosensor;

checking the inclination of the optical axis of the photosensor relative to the vertical direction; and mounting the sensor retainer to an apparatus body at an attitude such that the optical axis of the photosensor falls within a predetermined adjusted range relative to the media conveyance path.

* * * * *